US011130177B2

(12) United States Patent
Henderson et al.

(10) Patent No.: US 11,130,177 B2
(45) Date of Patent: Sep. 28, 2021

(54) METHODS FOR PRODUCING METAL POWDERS

(71) Applicant: Nanoscale Powders LLC, Boston, MA (US)

(72) Inventors: David Henderson, Concord, NH (US); Andrew Matheson, Belmont, MA (US); Richard Van Lieshout, New Freedom, PA (US); Donald Finnerty, New Freedom, PA (US); John W. Koenitzer, Carlisle, MA (US)

(73) Assignee: Nanoscale Powders LLC, Boston, MA (US)

( * ) Notice: Subject to any disclaimer, the term of this patent is extended or adjusted under 35 U.S.C. 154(b) by 0 days.

(21) Appl. No.: 16/282,385

(22) Filed: Feb. 22, 2019

(65) Prior Publication Data

US 2020/0023440 A1 Jan. 23, 2020

Related U.S. Application Data

(63) Continuation of application No. 15/051,267, filed on Feb. 23, 2016, now Pat. No. 10,245,642.

(Continued)

(51) Int. Cl.

*B22F 9/20* (2006.01)
*B22F 9/24* (2006.01)

(Continued)

(52) U.S. Cl.

CPC ..... *B22F 9/24* (2013.01); *B22F 9/20* (2013.01); *C22B 5/04* (2013.01); *B22F 1/0018* (2013.01);

(Continued)

(58) Field of Classification Search

CPC .. B22F 9/20; B22F 9/24; B22F 1/0018; B22F 2201/10; B22F 2202/17; B22F 2301/052;

(Continued)

(56) References Cited

U.S. PATENT DOCUMENTS 1,437,984 A 12/1922 Marden
2,950,962 A 8/1960 Norman (Continued)

FOREIGN PATENT DOCUMENTS

GB 758602 A 10/1956

OTHER PUBLICATIONS

PCT/US2016/019139 Notification of Transmittal of the International Search Report and Written Opinion of the International Searching Authority dated Jun. 3, 2016 entitled "Methods for Producing Metal Powders".

*Primary Examiner* — Cam N. Nguyen
(74) *Attorney, Agent, or Firm* — Banner & Witcoff, Ltd.

(57) ABSTRACT

A method for producing a metal powder includes maintaining molten reducing metal in a sealed reaction vessel that is free of added oxygen and water, establishing a vortex in the molten reducing metal, introducing a metal halide into the vortex so that the molten reducing metal is in a stoichiometric excess to the metal halide, thereby producing metal particles and salt, removing unreacted reducing metal, removing the salt, and recovering the metal powder. The molten reducing metal can be a Group I metal, a Group II metal, or aluminum.

25 Claims, 7 Drawing Sheets

Related U.S. Application Data

(60) Provisional application No. 62/119,677, filed on Feb. 23, 2015.

(51) Int. Cl.
*B22F 1/00* (2006.01)
*C22B 5/04* (2006.01)

(52) U.S. Cl.
CPC ..... *B22F 2201/10* (2013.01); *B22F 2202/17* (2013.01); *B22F 2301/052* (2013.01); *B22F 2301/054* (2013.01); *B22F 2301/056* (2013.01); *B22F 2302/45* (2013.01)

(58) Field of Classification Search
CPC ..... B22F 2301/054; B22F 2301/056; B22F 2302/45; C22B 5/04
See application file for complete search history.

(56) References Cited

U.S. PATENT DOCUMENTS 2,990,270 A * 6/1961 Lefever ..... C22B 5/04 75/10.67
3,801,307 A * 4/1974 Hurd ..... C22B 5/04 75/395
3,829,310 A 8/1974 Mahy
3,847,596 A * 11/1974 Holland ..... C22B 5/06 75/619
3,861,660 A 1/1975 Ammann et al.
3,992,192 A 11/1976 Vartanian
4,032,328 A * 6/1977 Hurd ..... C22B 60/0291 75/395
4,067,736 A 1/1978 Vartanian
4,556,420 A * 12/1985 Evans ..... C22B 34/14 75/618
4,680,055 A 7/1987 Sharma
4,684,399 A * 8/1987 Bergman ..... B22F 9/24 75/363
4,687,632 A * 8/1987 Hurd ..... B22F 9/20 419/34
4,725,312 A * 2/1988 Seon ..... C22B 59/00 420/416
4,818,280 A 4/1989 Langner et al.
4,820,339 A * 4/1989 Bienvenu ..... B22F 9/18 75/368
6,786,951 B2 9/2004 He et al.
6,876,542 B2 4/2005 Oda et al.
7,431,751 B2 10/2008 Shekhter et al.
8,430,944 B2 4/2013 Iijima
8,562,712 B2 * 10/2013 Haidar ..... C22B 34/1277 75/10.21
8,673,051 B2 * 3/2014 Matheson ..... B22F 3/10 75/308
8,753,418 B2 * 6/2014 Epshteyn ..... C01B 6/02 75/345
9,067,264 B2 * 6/2015 Moxson ..... C01B 6/24
9,108,247 B2 * 8/2015 Epshteyn ..... C01B 6/02
9,393,623 B2 * 7/2016 Rasheed ..... C22B 34/24
9,562,296 B2 * 2/2017 Ito ..... C01B 33/023
9,586,262 B2 * 3/2017 Matheson ..... B22F 1/02
9,679,675 B2 * 6/2017 Matheson ..... H01B 5/00
10,610,929 B2 * 4/2020 Fang ..... B22F 1/0014
2003/0110890 A1 * 6/2003 He ..... B22F 9/24 75/363
2008/0105084 A1 * 5/2008 Crawley ..... C22B 5/02 75/343
2015/0266098 A1 * 9/2015 Irizarry-Rivera ..... B22F 1/0011 428/546

* cited by examiner

METHODS FOR PRODUCING METAL POWDERS

CROSS-REFERENCE TO RELATED APPLICATIONS

This application is a continuation of commonly owned U.S. application Ser. No. 15/051,267, filed Feb. 23, 2016, now U.S. Patent No. 10,245,642. The '267 Application claims the benefit of U.S. Provisional Application No. 62/119,677, filed on Feb. 23, 2015. The entire teachings of these applications are hereby incorporated herein by reference.

BACKGROUND OF THE INVENTION

Metal powders can be used for advanced metallurgical processes, such as near net shape powder pressing, and additive manufacturing, including laser metal deposition (LMD), direct metal laser sintering (DMLS), selective laser sintering (SLS), and selective laser melting (SLM). The end products find applications in a wide variety of industries, including aerospace, medical, and electronics. Other applications include the production of wire bar stock for rolling into medical alloys (e.g., superconducting wires for MRI machines), sputtering targets in electronics manufacturing for thin film metal deposition in displays, use in semiconductors and data storage devices, superalloy production, intermetallic powders for the manufacture of jet engine components, and photovoltaic cells. Metal powders can also be pressed into dense objects using conventional pressing techniques.

Preferably, metal powders are highly pure and have consistent flow properties. However, processes for achieving metal powders having such characteristics require further development. Accordingly, there is a need in the art for methods of making pure metal powders that have adequate flow properties such that the powders can be used for advanced manufacturing applications.

SUMMARY OF THE INVENTION

In one embodiment, a method for producing a metal powder includes maintaining molten reducing metal in a sealed reaction vessel that is free of added oxygen and water, establishing a vortex in the molten reducing metal, introducing a metal halide into the vortex so that the molten reducing metal is in a stoichiometric excess to the metal halide, thereby producing metal powder and a salt, removing the unreacted reducing metal, removing the salt, and recovering the metal powder. The molten reducing metal can include a Group I metal, a Group II metal, or aluminum. The metal halide can include a halide, particularly a chloride, of tantalum, tungsten, niobium, nickel, aluminum, zirconium, vanadium, tin, titanium, silicon, niobium, and hafnium. The metal halide can also include halides, particularly chlorides, of rare earth elements and refractory metals. The metal halide can be a mixture of metal halides. The vortex can be created by stirring the molten reducing metal with a bladed stirrer in the reaction vessel at a speed of about 500 rpm to about 6000 rpm, preferably about 1000 rpm to about 4000 rpm, or even more preferably about 1000 rpm to about 2500 rpm. Preferably, the tip speed of the bladed stirrer is between about 4000 feet per minute and 6000 feet per minute, even more preferably between about 4500 and 5500 feet per minute. Typically, the mixing speed increases as the reaction proceeds and the extent of reaction increases. The molten reducing metal can include sodium, potassium, magnesium, calcium, or any mixture thereof. The molten reducing metal can include a mixture of sodium and potassium or an alloy of sodium and potassium. In some instances, the molten reducing metal can contain magnesium, calcium, or both. In some instances, the molten reducing metal can contain aluminum. The molten reducing metal can be maintained at a temperature of about 150° C. to about 850° C., or preferably about 150° C. to about 350° C., or more preferably about 200° C. to about 250° C. In some instances, the molten reducing metal is maintained at a temperature of about 600° C. to about 700° C. The molten reducing metal can be in at least a 5:1 stoichiometric excess to the metal halide, though in some cases it can be less than a 5:1 stoichiometric excess. In other cases, it can be more than a 5:1 stoichiometric excess, such as at least a 10:1 stoichiometric excess. The reaction vessel that is free of added oxygen and water can be filled or purged with an inert gas, preferably argon, prior to or while maintaining the molten reducing metal in the sealed reaction vessel. Removing the unreacted reducing metal can include siphoning off the unreacted reducing metal or evaporating the unreacted reducing metal. Removing the unreacted reducing metal can also include reacting the unreacted reducing metal with an anhydrous chloride, such as anhydrous hydrogen chloride or chloride gas. Removing the salt can include washing the metal particles with water, or evaporating by heating and sweeping with an inert gas. Recovering the metal powder can include drying the metal powder. The metal powder can be an alloy. The metal halide can be a powder or a liquid or a mixture thereof.

In another embodiment, a method for producing a metal powder consists essentially of maintaining molten reducing metal in a sealed reaction vessel that is free of added oxygen and water, establishing a vortex in the molten reducing metal, introducing a metal halide into the vortex so that the molten reducing metal is in a stoichiometric excess to the metal halide, thereby producing metal powder and a salt, removing the unreacted reducing metal, removing the salt, and recovering the metal powder. The molten reducing metal can include a Group I metal, a Group II metal, or aluminum. The metal halide can also include halides, particularly a chloride, of tantalum, tungsten, niobium, nickel, aluminum, zirconium, vanadium, tin, titanium, silicon, niobium, and hafnium. The metal halide can include halides, particularly chlorides, of rare earth elements and refractory metals. The metal halide can be a mixture of metal halides. The vortex can be created by stirring the molten reducing metal with a bladed stirrer in the reaction vessel at a speed of about 500 rpm to about 6000 rpm, preferably about 1000 rpm to about 4000 rpm, or even more preferably about 1000 rpm to about 2500 rpm. Preferably, the tip speed of the bladed stirrer is between about 4000 feet per minute and 6000 feet per minute, even more preferably between about 4500 and 5500 feet per minute. Typically, the mixing speed increases as the reaction proceeds and the extent of reaction increases. The molten reducing metal can include sodium, potassium, magnesium, calcium, or any mixture thereof. The molten reducing metal can include a mixture of sodium and potassium or an alloy of sodium and potassium. In some instances, the molten reducing metal can contain magnesium, calcium, or both. In some instances, the molten reducing metal can contain aluminum. The molten reducing metal can be maintained at a temperature of about 150° C. to about 850° C., or preferably about 150° C. to about 350° C., or more preferably about 200° C. to about 250° C. In some instances, the molten reducing metal is maintained at a temperature of about 600° C. to about 700° C. The molten reducing metal can be in at least a 5:1 stoichiometric excess to the metal halide, though in some cases it can be less than a 5:1 stoichiometric excess. In other cases, it can be more than a 5:1 stoichiometric excess, such as at least a 10:1 stoichiometric excess. The reaction vessel that is free of added oxygen and water can be filled or purged with an inert gas, preferably argon, prior to or while maintaining the molten reducing metal in the sealed reaction vessel. Removing the unreacted reducing metal can include siphoning off the unreacted reducing metal or evaporating the unreacted reducing metal. Removing the unreacted reducing metal can also include reacting the unreacted reducing metal with an anhydrous chloride, such as anhydrous hydrogen chloride or chloride gas. Removing the salt can include washing the metal particles with water, or evaporating by heating and sweeping with an inert gas. Recovering the metal powder can include drying the metal powder. The metal powder can be an alloy. The metal halide can be a powder or a liquid or a mixture thereof.

The metal powders produced by the methods described herein have a small particle size and improved flow characteristics, which can be determined using a Hall flow meter according to standardized testing procedures, such as ASTM B213. The methods described herein can produce primary particles having a size ranging from about 5 to about 250 nanometers. The primary particles can form aggregates having a size from about 1 to about 250 microns in diameter. Particle size can be determined by scanning electron microscopy (SEM) imaging.

The metal powders produced by the methods described herein can be highly pure. In particular, the metal powders can have a minimal amount of oxygen bonded to the metal. Reducing the quantity of oxygen bonded to the metal powder has been technically challenging in the art, and thus improvements in metal powder purity represent a substantial technical improvement.

Another advantage of the methods described herein is that they can reduce the amount of corrosion that occurs. For example, prior art gas phase reactions typically offer a lower reaction throughput, and they can also yield substantial corrosion because of the increase in the reaction rate for chloride corrosion processes at elevated temperatures.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

Figure 1A:
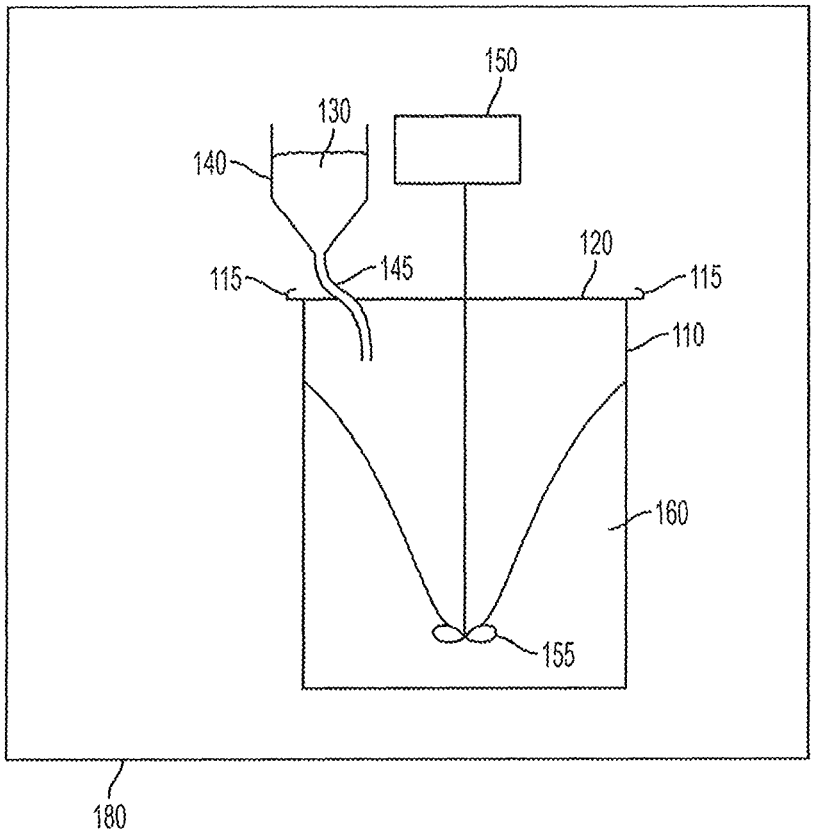
FIG. 1A is schematic illustration of a sealed reaction chamber suitable for conducting the metal halide reduction reaction of this invention.

A description of example embodiments of the invention follows.

Metal powders can be formed by reducing a metal halide with a molten reducing metal in a sealed reaction vessel that is free of added oxygen and water. A vortex can be established in the molten reducing metal, and the metal halide is introduced into the vortex, typically through a hopper and feed tube. Following this procedure, the molten reducing metal remains in a stoichiometric excess to the metal halide. Metal powders and a salt can be produced, which are first separated from the unreacted reducing metal. Next, the metal powder is separated from the salt, and then the metal powder is recovered. The reducing metal includes a Group I or Group II metal.

Three variables exhibit a high degree of influence on powder particle size: the temperature at which the reaction occurs, the relative concentration of the metal halide to the concentration of the reducing metal, and the melting point of the produced metal or alloy powder. Typically, the metal powder particle size is proportional to these variables according to Formula (1), where T is the temperature in Kelvin:

$$\text{Metal Powder Particle Size} \quad \alpha\left[\frac{[\text{Concentration of Metal Halide}]}{[\text{Concentration of Reducing Metal}]}\right]T^{\frac{1}{3}} \tag{1}$$

In view of the Formula (1), reaction conditions that favor the production of smaller particles include a lower temperature and a low concentration of metal halide relative to the concentration of the reducing metal. Without wishing to be bound by theory, the process of particle and aggregate formation parallels standard particle flame synthesis processes. Thus, when a primary particle or cluster encounters another cluster, they stick together to form an aggregate that tends to have an open structure, provided the conditions (temperature and particle density) permit continued aggregation. Thus, smaller aggregates are produced when the concentration of the metal halide is lower because the metal powder particles that form are more dispersed in the reducing metal, and therefore the metal powder particles are less likely to physically interact and form aggregates. Finally, the particles are large and cool enough that the aggregates freeze. Additionally, at higher temperatures the particles are stickier so they coalesce for longer. Therefore, the primary particles are larger and have a smaller surface area. At higher concentrations, the particles can collide and coalesce more rapidly before they cool, again leading to larger primary particles and lower surface area.

As described herein, reacting a metal halide with a molten reducing metal while subjecting the molten reducing metal to a vortex can yield particles that are highly pure and provide improved flow properties. Preferably, the reactions occur under conditions that remain constant or bounded by a limited range of temperatures and stoichiometry. The methods described herein typically involve four steps. First, the metal halide is reduced by the reducing metal to produce metal particles. Second, the remaining, unreacted reducing metal is removed from the metal particles. Third, the salt byproduct is removed. Fourth, the metal powder particles are recovered.

Metal Halide Reduction

In a first step, the metal halide is reduced to a metal powder and a salt is produced as a byproduct.

Metal halides can be reacted with a stoichiometric excess of a reducing metal. Metal halides that can be reacted include halides of tantalum, nickel, aluminum, zirconium, vanadium, tin, titanium, silicon, niobium, and hafnium. Typically, the metal halide is a metal chloride. The reducing metal includes a Group I or Group II metal. For example, the reducing metal can be sodium, potassium, magnesium, calcium, or mixtures thereof. Example reductions include: TaCl5 reduced by sodium; TaCl5 reduced by a mixture of sodium and potassium; HfCl4 reduced by a mixture of sodium and potassium; a mixture of TaCl5 and NiCl2 reduced by a mixture of sodium and potassium; AlCl3 reduced by sodium; ZrCl4 reduced by sodium; VCl4 reduced by sodium; SnCl4 reduced by sodium; TiCl4 reduced by sodium; and SiCl4 reduced by sodium. Subhalides (e.g., halides of lower oxidation states of the metal elements that contain less halide (e.g., TiCl2 or TiCl3) than its common halide (e.g., TiCl4)), including subchlorides, can also be reduced in the same manner, for example, titanium, zirconium, or tin subchlorides. An example reduction reaction proceeds according to Equation (2):

$$TaCl5(s)+5Na(l)\text{->}Ta(s)+5NaCl(s) \quad (2)$$

In order to generate the reaction, the reducing metal is heated to a temperature above its melting point and below its boiling point in a sealed reaction vessel that is free of added oxygen and water. Higher temperatures can lead to the generation of reducing metal vapors that must be controlled. For example, when the reducing metal is sodium, more typical reaction temperatures are from 150° C. to 350° C., though temperatures up to 850° C. are possible.

FIG. 1A is a schematic illustration of a sealed reaction chamber 180 suitable for conducting the metal halide reduction reaction. The reduction reaction condition occurs in a reaction vessel 110, which can be formed of steel. The reaction vessel 110 can have a lip 115 that can facilitate the placement of a lid 120 on top of the reaction vessel 110. Typically, the reaction vessel 110 is cylindrical. A mixer 150 having a mixing blade 155 creates a vortex or turbulent mixing conditions in the molten reducing metal 160. A variety of commercially available mixers adapted with a variety of impeller blades can be used. For example, a 70 Watt IKA mixer (IKA Works, Inc.) and a Cowles-type blade (supplied by, e.g., INDCO, Inc.) can be used to establish turbulent mixing. Preferably, the mixer is operated so that the tip speed of the blade is about 4000 to about 6000 feet per minute, although mixing at tip speeds down to 1000 feet per minute can be sufficient. In a commercial scale operation, the RPM at which the mixer is operated can decrease as the length of the mixer blade increases. A countervailing factor is that the required tip speed increases as the diameter of the reactor increase. The reaction vessel 110 can provide the heat necessary to melt the reducing metal 160.

Figure 1B:
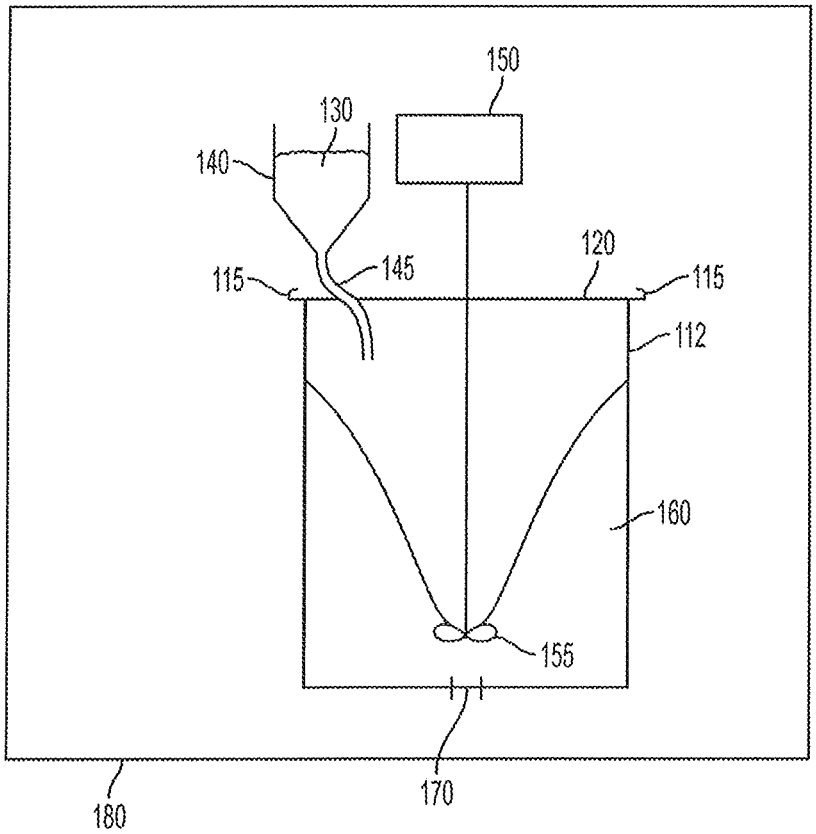
FIG. 1B is a schematic illustration of another sealed reaction chamber suitable for conducting the metal halide reduction reaction of this invention.

Metal halide 130 can be fed into the reaction vessel 110 via a hopper 140. The hopper 140 can have a feed tube 145 that can control the deposition of the metal halide 130 such that it is deposited into the vortex of the molten reducing metal 160. The metal halide 130 can be introduced into the reaction vessel 110 in the space above the vortex of the molten reducing metal 160, as indicated in FIGS. 1A and 1B, or it can be introduced directly under the surface of the molten reducing metal 160. Since the metal halide 130 is added to a reservoir of reducing metal 160, the reducing metal 160 is present in an instantaneous stoichiometric excess. In other words, by feeding the metal halide 130 to the reducing metal 160 at a steady rate, the instantaneous stoichiometry of the reactants is such that the reducing metal 160 is present in a stoichiometric excess. Typically, the reducing metal 160 is present in an overall stoichiometric excess as well. Metal halides 130 are typically added until the reducing metal become stiff and the vortex collapses. For example, metal halides can be added up to about 40% by weight of the metal halide relative to the reducing metal. In some cases, the reducing metal is present in an overall stoichiometric excess of 5 to 1. In some cases, the reducing metal is present in an overall stoichiometric excess of 10 to 1. In some instances, the reducing metal 160 is heated between approximately 150° C. and approximately 350° C., which can permit partial consumption of the reducing metal 160. In other instances, the reducing metal 160 can be heated as high as approximately 850° C. When the reducing metal 160 is heated to a higher temperature, a greater percentage of the reducing metal 160 is consumed in the reaction because if the byproduct halide salt becomes molten, the vortex can be preserved to higher levels of metal halide loading. When heating the reducing metal to a higher temperature, it is necessary to ensure that the mixer 150, mixer blade 155, reaction vessel 110, and other components can withstand the elevated temperatures. After the metal halide 130 has been added to the molten reducing metal 160, a metal powder, a salt byproduct, and excess reducing metal remain.

FIG. 1B is a schematic illustration of another sealed reaction chamber 180 suitable for conducting the metal halide reduction reaction. The reaction chamber of FIG. 1B is similar to that of FIG. 1A, except that the reaction vessel 112 includes a port 170 at the bottom of the reaction vessel 112. The port 170 can be a freeze plugging valve. One advantage of using the reaction vessel of FIG. 1B is that the reaction vessel 112 does not need to be tipped over in order to empty the contents.

The sealed, reaction chamber 180 can be an airtight glovebox. An airtight glovebox can be constructed largely of glass plates attached to a metal frame. A glovebox permits an operator to manipulate objects within the glovebox while maintaining an inert reaction environment.

The reaction chamber depicted in FIGS. 1A and 1B can be a bench-top glovebox, or it can be a larger glovebox suitable for pilot scale operations, in which case it may have work stations where several operators can access the interior of the glovebox. The reaction chamber can also be large enough to house industrial- or commercial-scale reaction vessels. For commercial scale production, an airtight vessel having automated loading and unloading can be used.

Recycling of Excess Reducing Metal

In a second step, the excess unreacted reducing metal is separated so that it can preferably be reused in another reduction reaction. The excess reducing metal can be as much as 50% by weight, or more in some cases, of the starting amount of reducing metal. Therefore, recovery and reuse of the reducing metal are important economic considerations.

Figure 2:
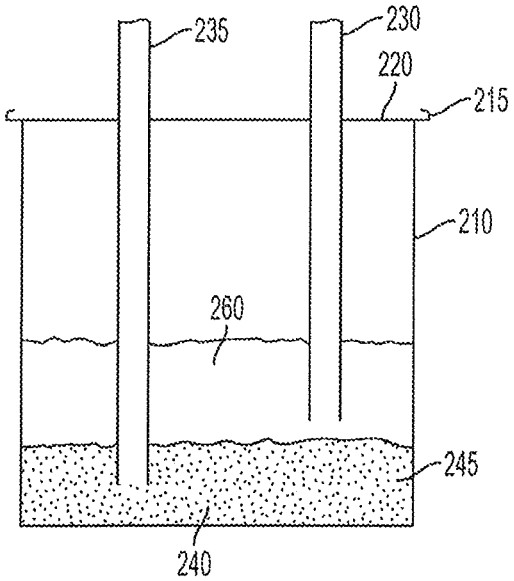
FIG. 2 is a schematic illustration of a suitable bakeout vessel.

As illustrated in FIG. 2, the excess reducing metal 160, along with the metal powder and salt formed during the first step, can be decanted into a bakeout vessel 210. The bakeout vessel 210 can have a lip 215 that can facilitate the placement of a lid 220 on top of the bakeout vessel 210. The bakeout vessel 210 can have one or more ports 230, 235 that can be used to remove material from the bakeout vessel 210. Preferably, the ports 230, 235 are adjustable so that they can extend to differing depths within the bakeout vessel 210.

Preferably, the ports 230, 235 are formed of a non-conducting ceramic in order to reduce long-range electron mediated reduction.

To recover the reducing metal, the bakeout vessel can be heated to just above the melting point of the salt formed as a reaction byproduct. For example, when the metal halide is titanium chloride and the reducing metal is sodium, the salt produced is sodium chloride, which has a melting point of approximately 801° C. In this example, the bakeout vessel 210 can be heated to just above 801° C., which is just above the melting point of sodium chloride. At this temperature, the sodium chloride salt begins to melt and separate from the reducing metal, thereby creating a salt bath 240 and a molten reducing metal phase 260. A small amount of the sodium dissolves in the molten sodium chloride salt (approximately 2 molar % at 801° C.). The salt bath phase 240 includes the metal powder 245 created by reducing the metal halide 130. A first port 230 can use used to siphon out the bulk of the excess molten reducing metal 260 by applying a negative relative pressure in a capture tank. This molten reducing metal 260 that has been siphoned off can be captured in a capture tank and reused.

The bakeout temperature can be adjusted by adding other salts and creating an eutectic system. For example, a 52:48 mix of calcium chloride and sodium chloride melts at approximately 500° C. Thus, the bakeout can occur in a lower temperature range (e.g., where stainless steel can be used instead of more expensive metals). By operating at a lower temperature, the surface area of the resulting metal powder can also be increased since a higher temperature leads to increased sintering.

Care should be exercised to determine the boundary between the molten reducing metal and the salt so that only the molten reducing metal is removed. Typically, it is not possible to siphon off all of the excess molten reducing metal 260. For example, there may be a layer of reducing metal 260 that is a few millimeters thick that remains after siphoning.

Alternatively, or in addition, the excess molten reducing metal can be poured off (decanted). Alternatively, or in addition, residual reducing metal can be reacted with an alcohol, such as methanol.

Once the reducing metal layer has been removed, the remaining reducing metal can be reacted with an anhydrous chloride, such as anhydrous hydrogen chloride (HCl) or chlorine gas (Cl2). However, the hydrochloric acid can attack the metal particles that have been formed. In order to protect the metal particles, a salt can be added to the bakeout vessel 210 either prior to or after pouring the molten reducing metal, salt, and metal powder into the bakeout vessel 210. Typically, the salt added is the same salt formed during the reduction of the metal halide by the reducing metal. The salt produced in the neutralization reaction typically fills the voids in the metal, and chlorides can therefore attack the metal. By providing a layer of molten salt, direct contact between the halides and the metal can be reduced. Thus, the chloride tends to neutralize the free sodium, which has valence electrons having a long mean free path in the molten salt.

The resulting product is a metal powder at least partially encapsulated in salt. The salt tends to have a glass-like appearance because it was melted and cooled.

Salt Removal

In a third step, the salt is removed. Metal powder having a higher surface area is generally less dense and contains more salt in narrower voids.

In a first method of removing the excess salt from the metal particles, the metal particles encapsulated in salt are washed with water. Preferably, the metal particles encapsulated in salt are transferred to a new vessel prior to the water wash in order to prevent oxidation of the bakeout vessel. Frequently, the metal particles are washed in serial batches in a metal beaker or other metal container so that the concentration of salt is less than 1 ppm. An example reaction for removing excess salt is Equation (3), after which the liquids and dissolved solids are removed:

$$\mathrm{Ta}(s)+5\mathrm{NaCl}(s)+2\mathrm{H2O}(l)\text{->}\mathrm{Ta}(s)+5\mathrm{NaCl}(aq)+2\mathrm{H2O}(l) \quad (3)$$

In a second method of removing the excess salt from the metal particles, the salt can be evaporated. One method of evaporating the salt is by sweeping an inert gas, such as argon, through the chamber at a temperature close to or above the melting point of the salt, such that the salt has an adequate vapor pressure to permit it to be removed in a reasonable time. The salt vaporizes, leaving behind the metal particles. The procedure can be conducted within a rotary furnace, which can limit the formation of a sponge from the metal particles. Preferably, the inert gas can be recycled.

In a third method of removing the excess salt from the metal particles, ultrafiltration can be used to remove excess salts. One such system is provided by Koch Membranes.

Metal Powder Recovery

In a fourth step, the metal particles are recovered and can be subsequently dried if desired. For examples, the particles can be dried in a vacuum oven. After drying the metal particles can be collected and recovered as a free flowing powder.

When the metal powder is exposed to air, it can be highly flammable, and its dust can be explosive. Thus, it must be handled with care, and preferably in an inert atmosphere, until the powder has been consolidated into a desired final form or else until the powder surface has been passivated by controlled exposure to oxygen.

Example 1—Halide Powder Feed Test

Instrumentation Setup

A powder trickler was used for all halide powder trials to feed the reactant powders to a beaker containing alkali metal(s). This powder feeder consists of an adjustable hopper, discharge tube, stand, and 2-speed control pad. All reactant powders flowed readily through the tube given the vibration frequency at hand, except the TaCl5 and NiCl2 50/50 powder blend. This powder blend packed tightly inside both the tube and the hopper base. As a result, remaining powder was fed to the reaction beaker using a "hand-add" approach with a spatula for the TaCl5 and NiCl2 50/50 blend.

All tests utilized an IKA 70 Watt mixer with the capability of producing speeds from 60 to 2000 rpm. A stainless steel, 1.20 inch diameter, turbine impeller blade was utilized for the first two tests performed, TaCl5 in excess sodium. All subsequent tests were performed using a stainless steel, 1.65 inch diameter, Cowles blade impeller to improve the incorporation of the reactant powder in the alkali metal. Even though the mixer maximum capacity was specified as 2000 rpm maximum, the mixer was utilized at speeds as high as 2135 rpm in the powder feed tests.

A stainless steel 2000 mL beaker was implemented as the reaction vessel for all tests. A lid was constructed for trial 3 with 3 ports for the mixer impeller, powder feed tube, and alkali metal temperature thermocouple (TE-0111A). The lid eliminated a large amount of dusting within the glovebox while allowing for the reactant powder to be fed down into the alkali metal via a vertical feed tube. The 4th and 5th trials used a similar lid with a reduced diameter port to further minimize dusting to the glovebox.

Figure 3:
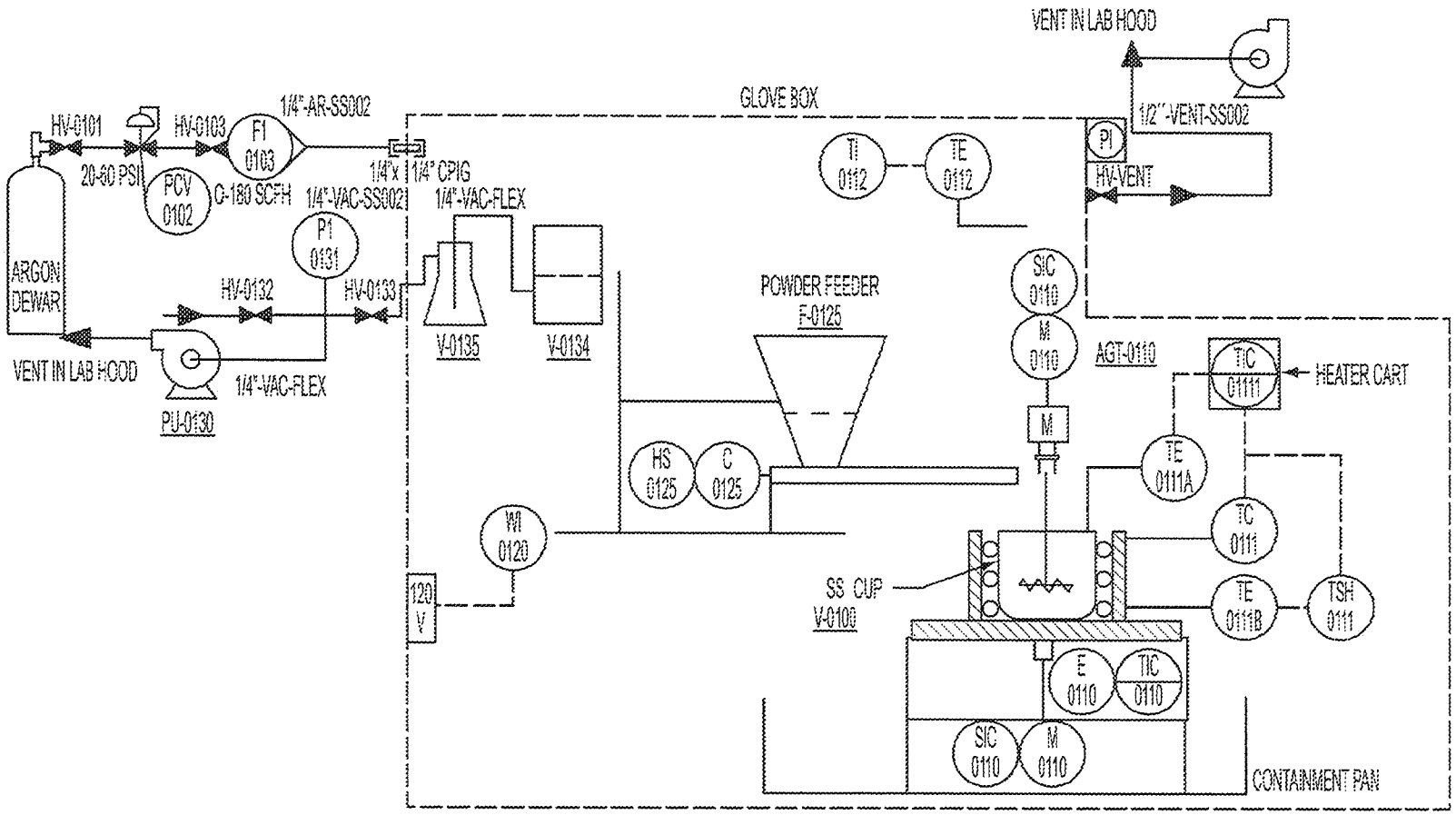
FIG. 3 is a piping and instrumentation diagram (P&ID) of an example reaction test setup.

FIG. 3 is a P&ID of the test setup. The stainless steel beaker, V-0100, contained the alkali reducing metal. The reaction beaker was maintained at 200°–250° C. using a heater band (controlled via TC-0111) and a hot plate (controlled via TC-0110). The variation in alkali metal temperature was based upon the reactivity of the halide powder during each trial via physical observation. Halide powders were pre-weighed using scale WI-0120 and fed from the powder feeder, F-0125, to V-0100 in 5-10 gram increments.

Argon was fed from an argon supply Dewar to the glovebox at a flow rate of 110 standard cubic feet per hour (scfh). Argon pressure was regulated down to 20-30 psig. The glovebox oxygen and moisture content was recorded prior to the start of each trial. Before any halide powders were exposed to the glovebox internals, the blower was de-energized and the purifier was isolated in an effort to preserve the integrity of the purifier. With the purifier isolated from the system, oxygen content was not accurately displayed on the glovebox control panel because the oxygen sensor was also sensitive to chlorides, and therefore provided an inaccurate reading due to the presence of chloride vapors in the glovebox.

A vacuum filtration system was incorporated for the trials using NaK. This system consists of a filtration separation vessel, V-0134, that contains a 10 micron screen inserted within a stainless steel cup to retain the solids. A catch vessel (flask), V-0135, was used to prevent any filtered NaK carry-over and to protect the vacuum pump, PU-0130. This vacuum filtration set-up was also used to perform the methanol wash steps within product recovery when NaK was utilized.

Test Procedure and Results

A first experiment was conducted to assess the minimum reaction temperature and mixing parameters. In this first experiment, an inert atmosphere having as little oxygen and moisture as possible was established in the glovebox. The hot plate and heater bands were energized and set to 200° C. Once the alkali metal was up to temperature, a pinch test was performed by adding a small amount of reactant powder to the alkali metal. The pinch test must be performed with the lid removed from the vessel to observe for signs of reaction (such as a change in color or the generation of smoke). If no sign of reaction was observed at 200° C., then the temperature was increased in increments of 50° C. and the pinch test was repeated until a reaction was observed. All reactions were performed at 250° C. or less.

The halide powders were manually weighed in 5-10 gram increments before being added to the hopper. Powder was fed from the hopper to the vessel, with pauses in feeding when smoking was observed. When the reaction step was completed, the mixer, heater band, and hot plate were de-energized to allow for the system to cool before the start of product recovery.

A total of five experiments was performed; two utilized TaCl5 and molten sodium, whereas the remaining three reacted TaCl5, HfCl4, and a 50/50 (wt. %) mix of TaCl5 and NiCl2, each with NaK alloy. A consolidation of the test results displaying the amount of fed halide powder, the amount of alkali metal used, and the final amount of collected product after vacuum drying can be viewed for each test in Table 1 below.

TABLE 1

Reactant Charges and Fractional Yield Summary

| Test | Fed Halide Powder (g) | Charged Alkali Metal (g) | Recovered Product (g) | Fractional Yield (actual/theoretical product) |
|---|---|---|---|---|
| 1. $TaCl_5$ in Excess Na | 0.50 | 90.00 | 0.05 | 19.8% |
| 2. $TaCl_5$ in Excess Na | 19.15 | 957.00 | 0.50 | 5.2% |
| 3. $TaCl_5$ in Excess NaK | 41.16 | 748.00 | 13.60 | 65.4% |
| 4. $HfCl_4$ in Excess NaK | 23.78 | 718.70 | 9.80 | 74.0% |
| 5. $TaCl_5/NiCl_2$ in Excess NaK | 19.26 | 728.40 | 5.20 | 56.4% |

At the start of Test 5, NiCl2 showed no sign of reaction at 200° C. when performing a pinch test; however, a reaction was visible at 250° C. Therefore, Test 5 was performed at 250° C.

The 50/50 wt. % NiCl2/TaCl5 (Test 5) powder mix tightly packed within the hopper feed tube, as well as the base of the hopper, multiple times. As a result, approximately half of the feed was added to the NaK-containing vessel manually using a spatula.

For the first two trials utilizing sodium, filtration took place in the reaction beaker, with the second test using a removable screen (<500 mesh) placed within the vessel. Material was scraped from the reaction vessel (and screen for the second test) before adding methanol to react residual sodium held up within the product. The reaction products were centrifuged for 0.5-2.0 hours at 3000 rpm and decanted, and a second methanol wash was repeated, followed by a de-ionized water wash to passivate the tantalum product. A second de-ionized water wash was performed using nitric acid to achieve a solution with a pH of 2. After decanting, the sample was then vacuum dried overnight at 95° C.

For the trials performed with NaK, the vacuum filtration system in the glovebox was utilized to remove the excess NaK from the reacted product. Two methanol washes were performed to react any NaK held up with the product, and vacuum filtration was used to remove excess solvent within the product cake. As with the first two tests, methanol washing was followed by a de-ionized water wash in the glovebox to passivate the product followed by centrifugation at 3000 rpm for 30 minutes and decanting. A total of five or six water washes were performed before the product was vacuum dried overnight at 85-95° C. Each test performed with NaK utilized varying deionized (DI) water solutions based on the product isoelectric points. Table 2 describes the pH of the solutions used for water washing as well as the number of washes performed. Solution pH was adjusted using nitric acid or sodium hydroxide.

TABLE 2

Water Wash Criteria for Products Generated Using NaK.

| Test | DI Water Wash Solution pH | No. of Performed Washes |
|---|---|---|
| 3. $TaCl_5$ in Excess NaK | 2-3 | 6 |
| 4. $HfCl_4$ in Excess NaK | 7 | 6 |

TABLE 2-continued

Water Wash Criteria for Products Generated Using NaK.

| Test | DI Water Wash Solution pH | No. of Performed Washes |
|---|---|---|
| 5. $TaCl_5/NiCl_2$ in Excess NaK | Half at 2.50-3.0; Half at 10-11 | 5 |

Other observations include the following:

Significant dusting was observed in the glovebox for Tests 1 and 2, which were performed with an open lid. The rotation of the mixer shaft can create argon currents that disperse some of the powder feed. Dusting was observed again for Test 3, but dusting significantly decreased so that very little was observed for Tests 4 and 5, which utilized a lid.

When draining excess sodium from the product in Test 2, it was difficult to determine if the sodium drained through the inner mesh strainer assembly or if a hole was present in the mesh. Furthermore, some dark material (most likely product Tantalum) was removed with the excess sodium, and caught in the <500 mesh strainer.

Sufficient mixing was established with the mixer running at 1625-1675 rpms in Test 3; however, once powder addition began, the mixing speed was increased to 1750 rpms to maintain a good vortex and surface movement.

The hafnium tetrachloride powder used in Test 4 was denser and chunkier than the tantalum pentachloride previously used. Larger HfCl4 chunks appeared to sink in the NaK with no visible signs of reaction, whereas the loose, fine powder generated smoke and changed in color from white to black upon contact with NaK. The HfCl4 powder was filtered to remove these larger chunks prior to feeding the hopper and starting the reaction.

At the start of Test 5, NiCl2 showed no sign of reaction at 200° C. when performing a pinch test; however, a reaction was visible at 250° C. Therefore, Test 5 was performed at 250° C.

The 50/50 wt. % NiCl2/TaCl5 powder mix tightly packed within the hopper feed tube, as well as the base of the hopper, multiple times. As a result, approximately half of the feed was added to the NaK-containing vessel manually using a spatula.

The amount of fed halide powder used in the last, fifth trial is a best estimate due to losing approximately 0.86 g when the feed tube on the lid assembly plugged during the feeding process.

Salt Concentration Test

A salt concentration test was performed to assess the quantity of metal halides that can be added while maintaining a vortex. A total of 797.17 grams of sodium were used, and a total of 477.69 g NaCl were added over the course of the trial. The first five salt charges were added in increments of 10 g, and all subsequent charges were fed in 25 g increments.

After feeding 154.88 g of NaCl, a white-grey film skimmed over the surface of the sodium and surface motion was halted. When increasing the mixer speed from 1611 to 1750 RPMs, surface motion resumed in pockets. At a mixing speed of 1950 rpms, swirling became visible, but a vortex was still not observed. At 2008 rpms, an off-centered vortex developed to the left of the mixer shaft.

Once NaCl addition reached 399.74 g, surface movement again ceased, but regenerated after four minutes of no movement. After adding 424.74 g of NaCl, movement again ceased, but was re-initiated by probing the surface with a flat blade. The salt feed was stopped at 477.69 g, after changes in fluid density and viscosity were observed and surface mixing no longer occurred.

Conclusions

All tests demonstrated that the halide powder-alkali metal reactions can be performed at 200° C. except for NiCl2, which should be reacted with alkali metals at 250° C.

A dispersion of sodium and sodium chloride can have approximately 33 to 37 wt. % salt before changes in fluid density and viscosity were observed and surface mixing no longer occurred.

Example 2—Halide Powder and Liquid Initiation Test

Instrumentation Setup

A second set of experiments was conducted to verify the reactivity of various powder and liquid halides with sodium metal. All tests were performed in a glovebox, inerted with Argon to eliminate oxygen and moisture from the atmosphere.

Powder halide transfer: Aluminum Chloride and Zirconium (IV) Chloride powders were transferred into weighing dishes using a microspatula. The powders were then poured into the reaction cups from the weighing dishes.

Liquid halide transfer: Vanadium (IV) Chloride, Tin (IV) Chloride, Titanium (IV) Chloride, and Silicon Tetrachloride were transferred into the reaction cups using 1 mL syringes. For each liquid halide, a volume of 0.1 mL was transferred into a syringe. The syringes were then placed in the glovebox. The syringes were then used to inject drops of each liquid halide into a reaction cup containing molten sodium metal.

Reaction vessel: Stainless steel 2.5 oz cups were implemented as the reaction vessels for all tests. When not in use, stainless steel foil was placed on top of each reaction cup.

Figure 4:
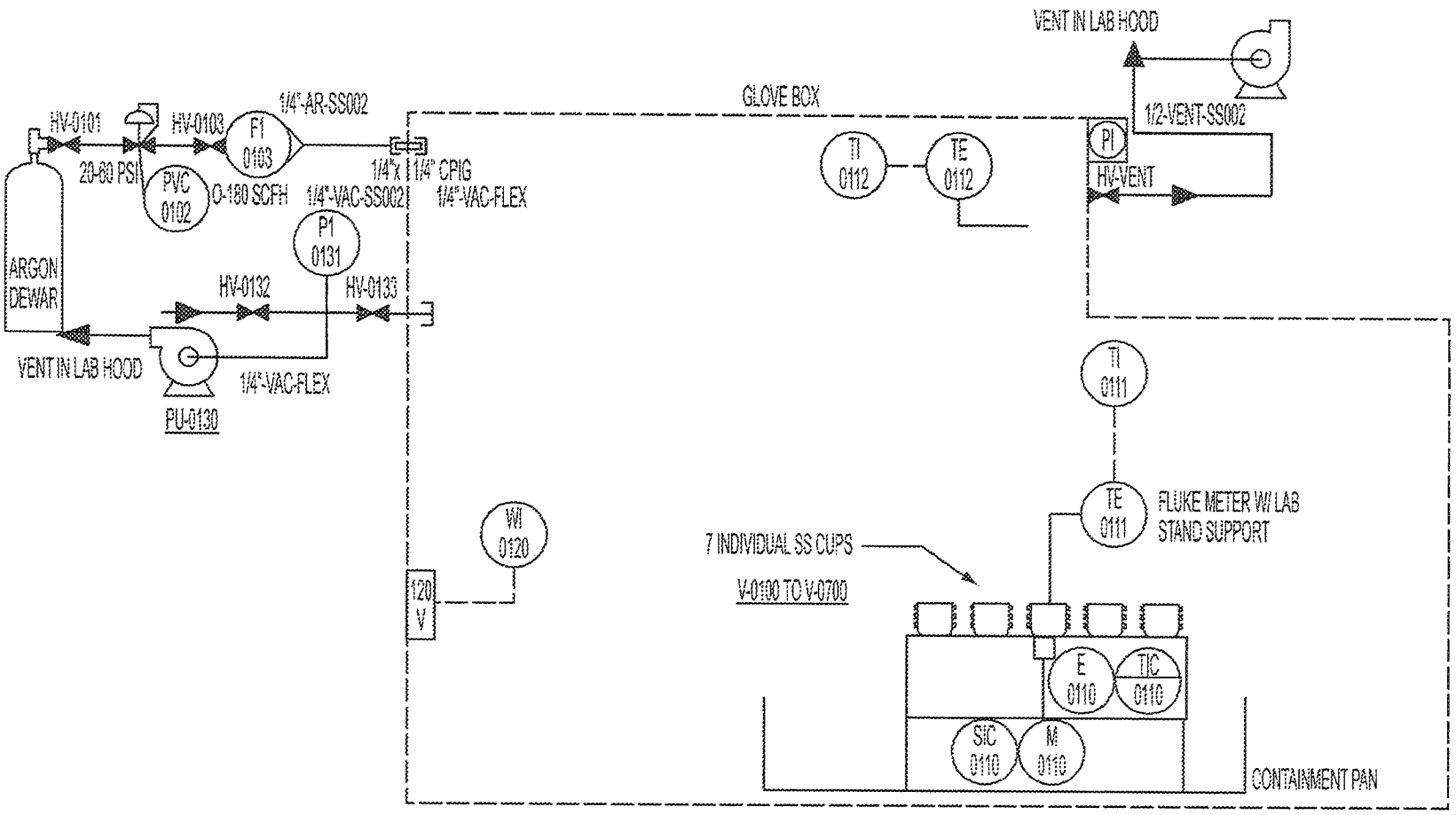
FIG. 4 is a P&ID of an example reaction test setup.

FIG. 4 is a P&ID of the test setup. Each stainless steel cup, V-0100 through V-0600 contained sodium metal. The reaction cups were maintained at 240-260° C. using a hot plate (manually controlled via TC-0110). Halide powders were pre-weighed using scale WI-0120 and poured into V-0100 and V-0200. The scale used to weigh the powder halides only displays increments of 0.1 grams; therefore, the amount of halide powders added to each reaction cup was known to be less than 0.1 grams. Halide liquids were injected into the reactions cups using 1 mL syringes. Because of the limited dexterity in the glovebox and hazards associated with handling syringe needles, the liquid halides were transferred from storage bottles into syringes under the fume hood. The syringes were then placed in the glovebox. For each halide liquid, 0.1 mL or less was injected into the reaction cups V-0300 through V-0600. The setup for the liquid halides was the same with the exception that four reaction cups were used instead of two.

Argon was fed from an argon supply Dewar to the glovebox at a flow rate of 65-70 scfh. Argon pressure was regulated down to 20-30 psig.

The glovebox oxygen and moisture content was recorded prior to the start of each trial. Before any halide powders were exposed to the glovebox internals, the blower was de-energized and the purifier was isolated in an effort to preserve the integrity of the purifier. With the purifier isolated from the system, oxygen content was not accurately displayed on the glovebox control panel.

Test Procedure and Results

Each test began with equipment set-up in the glovebox, and establishing an inert atmosphere. The hot plate was energized and set to 250° C. In order to reach and maintain a sodium temperature of 250° C., the hot plate was set between 350° C. and 400° C. Once the sodium metal was up to temperature, the halides were added to the reactions cups one at a time. The tests were performed with the lid (foil) removed from the cup to observe signs of reaction (such as a change in color or the generation of smoke). If no sign of reaction was observed at 250° C., then the temperature was increased in increments of 50° C. and the test was repeated until a reaction was observed. All reactions were performed at 250° C. in order to establish a safe minimum temperature.

Two experiments with halide powders were performed utilizing powdered AlCl3 and ZrCl4 reacted with molten sodium. Table 3 lists the consolidated test results displaying the amount of halide powder added, the amount of sodium metal used, the reaction temperature, and any observations during the reaction.

TABLE 3

Halide Powder Reaction Results

| Test | Halide Powder Added (g) | Charged Sodium Metal (g) | Reaction Temp (C.) | Observations |
|---|---|---|---|---|
| 6. $AlCl_3$ in Excess Na | <0.1 | 9.7 | 245 | Color change to dark gray |
| 7. $ZrCl_4$ in Excess Na | <0.1 | 9.9 | 250 | Color change to dark gray |

Other observations from the test include the following: ZrCl4 did not react as immediately as AlCl3.

Four experiments were performed utilizing liquid VCl4, SnCl4, TiCl4, and SiCl4 reacted with molten sodium. Table 4 lists the consolidated test results displaying the amount of halide liquid added, the amount of sodium metal used, the reaction temperature, and any observations during the reaction.

TABLE 4

Halide Reaction Results

| Test | Halide Liquid Added (mL) | Charged Sodium Metal (g) | Reaction Temp (C.) | Observations |
|---|---|---|---|---|
| 8. $VCl_4$ in Excess Na | 0.1 | 10.0 | 245 | Color change to black<br>Temperature increase of 3° C. |
| 9. $SnCl_4$ in Excess Na | 0.03 | 9.9 | 256 | Color change to dark gray<br>Blue flame<br>Some $SnCl_4$ evaporation |
| 10. $TiCl_4$ in Excess Na | 0.02 | 10.0 | 251 | Color change to black<br>Some $TiCl_4$ evaporation |
| 11. $SiCl_4$ in Excess Na | 0.08 | 10.1 | 251 | $SiCl_4$ mostly evaporated on sodium surface<br>Color change to dark gray |

Other observations from the tests include the following:

After transfer into the syringes, fuming out of the end of the needle was noticed with VCl4, SnCl4, and TiCl4. In the case of SnCl4 and TiCl4, fuming stopped once the needles were inserted into rubber stoppers. In the case of VCl4, fuming continued for 2 minutes after the needle was inserted into the rubber stopper.

There was some pressure build up with the VCl4 syringe. Some VCl4 was released from the syringe when the stopper was removed from the end of the needle while in the glovebox.

TiCl4 changed from clear to yellow while in the syringe.

There appeared to be more oxide on the sodium surface for the SiCl4 reaction which could have resulted in the majority of the SiCl4 laying on the surface and slowly evaporating instead of reacting. SiCl4 is also more volatile than the other liquid halides tested.

Conclusions

AlCl3, ZrCl4, VCl4, SnCl4, TiCl4, and SiCl4 all react with sodium at approximately 250° C. There is potentially some evaporation when the liquid halides are introduced to sodium at 250° C.

Example 3—Metal Powder Characterization

Particle flow can be measured according to a standardized protocol, such as by using a Hall flow meter according ASTM International Standard B213.

Molecular content of the metal powders produced by the methods described herein can be determined using LECO testers. For example, nitrogen and oxygen content can be tested with LECO Model TC436DR. Carbon and sulfur content can be tested with LECO Model CS444LS. Nitrogen, oxygen, and hydrogen content can be tested with LECO Model TCH600.

Purity can be assess by glow discharge mass spectrometry or inductively coupled plasma mass spectrometry.

Example 4—Titanium Powder 140 g of sodium metal was melted and brought to 250° C. in an Inconel reactor vessel. The sodium was then stirred using a Cowles blade mixer rotating at 2200-2300 rpm. Liquid titanium chloride (from Sigma Aldrich) was fed over approximately 1 hour into the stirred sodium, until 60 g of titanium chloride had been added, at which point the reaction was stopped by turning off the feed so that titanium chloride is no longer added to the reaction vessel. At the end of the reaction, the vortex in the sodium had substantially disappeared.

Once the reaction was completed, the reactor vessel was sealed, transferred to a furnace, and heated to 825° C. for four hours to reduce the surface area of the titanium metal produced in the reaction.

After the high temperature treatment, the unreacted sodium was removed from the reaction products and the titanium powder, coated in salt, was washed in water to remove the coating of sodium chloride encapsulating the metal. Washing continued until washwater conductivity fell below 2 microsiemens.

The recovered titanium powder was dried overnight in a vacuum oven at 100° C.

The titanium powder thus produced was analyzed by inductively coupled plasma mass spectrometry (ICP-MS) and LECO instruments, and was found to contain below 150 ppm iron, below 300 ppm total transition metals, and below 3000 ppm oxygen. The results demonstrate that the titanium powder falls within purity limits as described in UNS No. R50550.

Figure 5A:
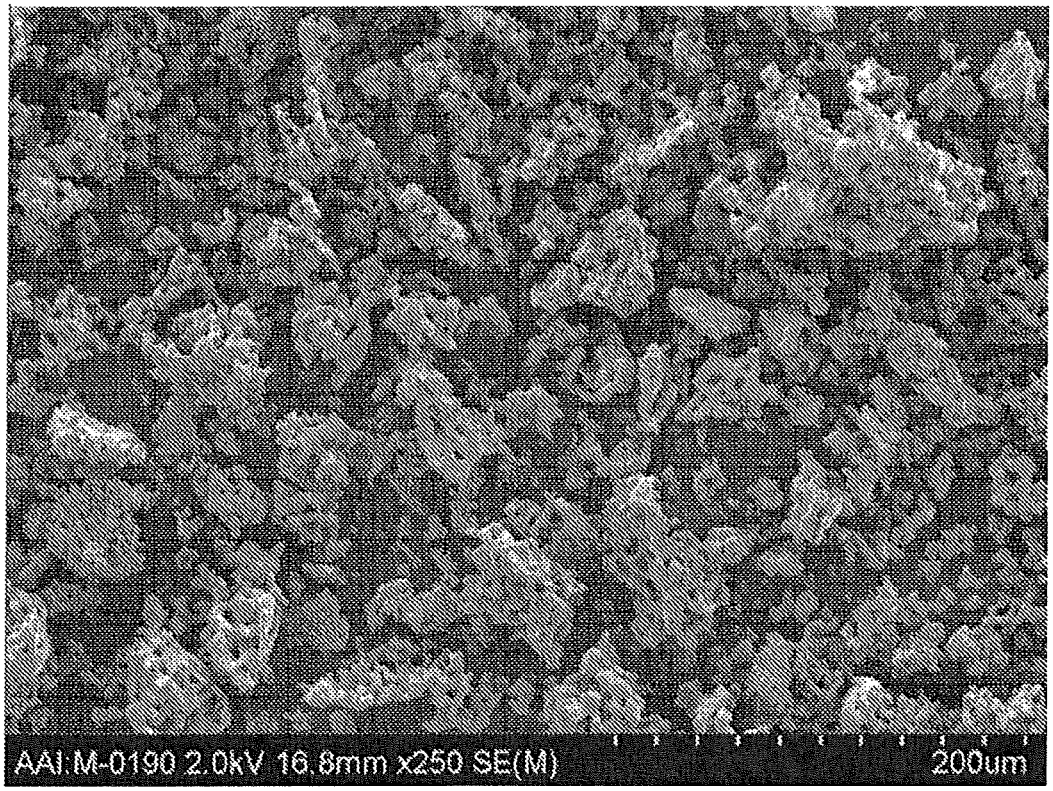
FIGS. 5A-B are scanning electron microscope (SEM) images of recovered titanium powder.
Figure 5B:
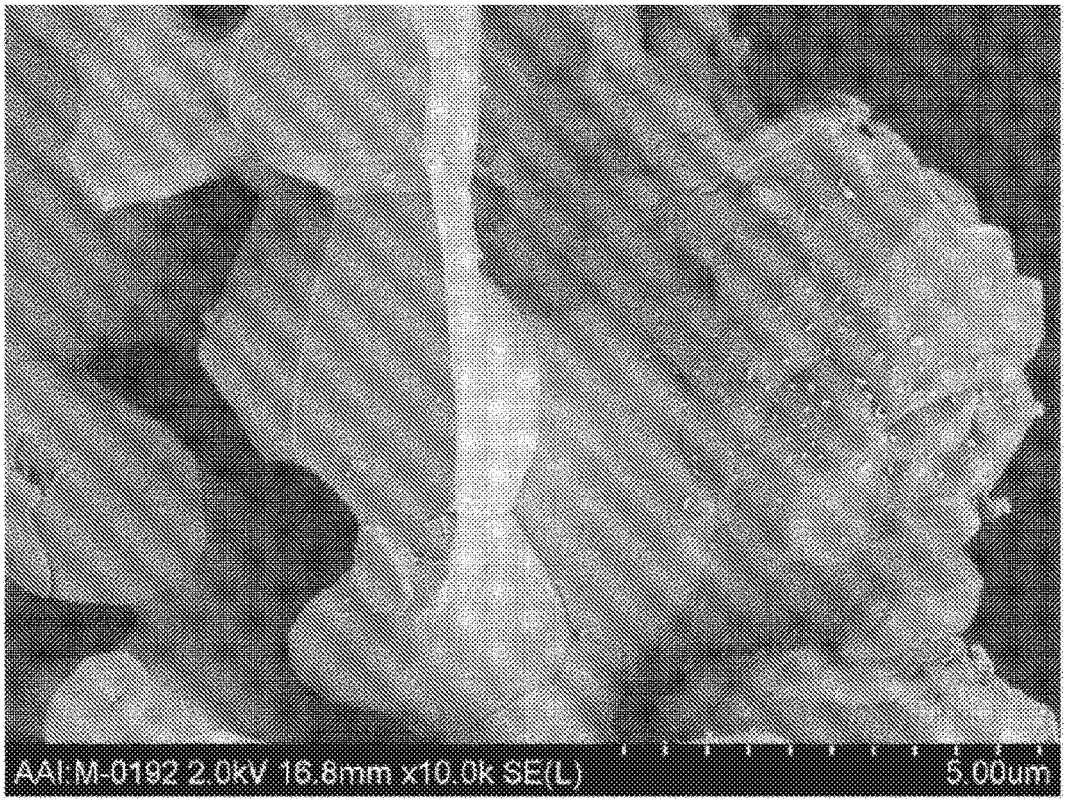

FIGS. 5A and 5B are scanning electron microscope images of the recovered titanium powder. Visual assessment of SEM images showed particle agglomerates predominantly in the 50 micron range, with primary structure mainly at 3-5 microns.

Example 5—Hafnium Metal 113 g of sodium metal was melted and brought to 250° C. in an Inconel reactor vessel. The sodium was then stirred using a Cowles blade mixer rotating at 2000-2500 rpm. Powdered hafnium chloride (from Areva) was pulse-fed over approximately 1 hour into the stirred sodium, until 82 g of hafnium chloride had been added, at which point the reaction was halted. At the end of the reaction, the vortex in the sodium had substantially disappeared and the reactor temperature had increased to 301° C.

Once the reaction was completed, the reactor vessel was sealed, transferred to a furnace, and heated to 825° C. for four hours to reduce the surface area of the hafnium metal produced in the reaction. During this process step, unreacted sodium was removed from the hafnium metal to leave a hafnium-sodium chloride composite.

The hafnium and sodium chloride mixture was then transferred to a vacuum furnace and heated under vacuum to 2300° C., held at that temperature for one hour, and then cooled. This removed the sodium chloride and produced a button of solid hafnium.

The hafnium button was analyzed via glow discharge mass spectrometry (GDMS) and found to have 26 ppm oxygen content, 1690 ppm zirconium, and less than 150 ppm total transition metals. The results demonstrate the production of a low oxygen hafnium metal produced directly from hafnium powder consolidation.

Example 6—Titanium-Aluminum 120 g of a 55% aluminum, 45% titanium powder (measured by metal content) was first prepared, by adding aluminum chloride powder (from Strem Chemical) to an aluminum-titanium chloride Ziegler Natta catalyst powder (also from Strem Chemical).

Next, 140 g of sodium metal was placed in an Inconel reactor and heated to 250° C. Over approximately 2 hours, 94 g of the titanium-aluminum chloride powder mix was pulse fed into the sodium, which was continuously stirred by a Cowles blade mixer at between 1600 and 2500 rpm. Powder addition continued until the mixer could no longer maintain a vortex in the sodium. At the end of the reaction the sodium temperature had increased to 292° C.

The Inconel reactor was then sealed, transferred to a furnace, and heated to 900° C. for 1 hour. After this step, the unreacted sodium was removed and the metal powder washed to remove its salt coating. Washing continued until the wash water conductivity fell below 2 microsiemens. Finally, the powder was dried in a vacuum over for 24 hours.

The titanium-aluminum metal thus produced was found by ICPMS analysis to contain below 1000 ppm iron and below 1500 ppm total transition metals.

Example 7—Titanium-Aluminum-Vanadium

First, 120 g of a titanium-aluminum-vanadium chloride mixture was prepared, by mixing liquid titanium chloride (from Sigma Aldrich), aluminum chloride powder (from Strem Chemical) and liquid vanadium chloride (from Acros Organics). The mixture was stirred constantly to maintain a dispersion of the aluminum chloride.

Next, 140 g of sodium metal was heated to 250° C. in an Inconel vessel and stirred by a Cowles blade mixer at speeds ranging from 1000 rpm initially, to 2500 rpm as the reaction progressed. The chloride mixture was pumped into the reactor until 74 g had been added, over approximately 90 minutes. The reaction stopped when the vortex in the sodium could no longer be maintained.

The reactor vessel was then sealed and transferred to a furnace, brought to 825° C. and held at that temperature for approximately one hour before being allowed to cool.

The recovered product was then washed to remove the sodium chloride coating the metal powder, and the powder was dried in a vacuum oven at 100 C for 24 hours.

Analysis of the metal powder using ICPMS showed the product contained under 50 ppm iron and under 150 ppm total transition metals. The results demonstrate that the titanium powder falls within the purity limits as described in UNS No. R56400.

INCORPORATION BY REFERENCE

The relevant teachings of all patents, published applications and references cited herein are hereby incorporated herein by reference.

EQUIVALENTS

While this invention has been particularly shown and described with references to example embodiments thereof, it will be understood by those skilled in the art that various changes in form and details may be made therein without departing from the scope of the invention encompassed by the appended claims.

What is claimed is:

1. A method for producing a metal powder, the method comprising:

(a) maintaining molten reducing metal in a sealed reaction vessel that is free of added oxygen and water, the molten reducing metal comprising a Group I metal, a Group II metal, or aluminum;

(b) establishing a vortex in the molten reducing metal;

(c) introducing a metal halide into the vortex so that the molten reducing metal is in a stoichiometric excess to the metal halide, thereby producing metal particles and a salt;

(d) removing unreacted reducing metal;

(e) removing the salt; and (f) recovering the metal powder.

2. The method of claim 1, wherein the metal halide includes a chloride of tantalum, nickel, aluminum, zirconium, vanadium, tin, titanium, silicon, niobium, and hafnium.

3. The method of claim 2, wherein the molten reducing metal comprises sodium.

4. The method of claim 2, wherein the molten reducing metal comprises potassium.

5. The method of claim 2, wherein the molten reducing metal comprises sodium and potassium.

6. The method of claim 2, wherein the molten reducing metal comprises magnesium.

7. The method of claim 2, wherein the molten reducing metal comprises calcium.

8. The method of claim 2, wherein the molten reducing metal comprises aluminum.

9. The method of claim 2, wherein the molten reducing metal is in at least a 5:1 stoichiometric excess to the metal halide.

10. The method of claim 1, wherein the metal halide is a mixture of metal halides.

11. The method of claim 1, wherein the reaction vessel that is free of added oxygen and water is filled or purged with an inert gas prior to or while maintaining the molten reducing metal in the sealed reaction vessel.

12. The method of claim 1, wherein removing the salt comprises washing the metal particles with water.

13. The method of claim 1, wherein removing the salt comprises evaporating by heating and sweeping with an inert gas.

14. The method of claim 1, further comprising drying the metal powder after recovering the metal powder.

15. The method of claim 1, wherein the metal powder is an alloy.

16. The method of claim 1, wherein the metal halide comprises a powder.

17. The method of claim 1, wherein the metal halide comprises a liquid.

18. The method of claim 1, wherein the unreacted reducing metal is removed from the reaction mixture by the phase separation process of a molten reducing metal from a mixture of a metal halide powder and a salt, wherein the molten reducing metal is in a stoichiometric excess to the metal halide;

wherein the molten reducing metal comprises a Group I metal, a Group II metal, or aluminum;

wherein the metal halide comprises a halide of tantalum, nickel, aluminum, zirconium, vanadium, tin, titanium, silicon, niobium, hafnium, or mixtures thereof; and wherein a vessel containing the vortex formed mixture is heated to a temperature above the melting point of the salt in the mixture, thereby forming a salt bath phase, which includes the metal powder, and a separate molten reducing metal phase, followed by separation of the molten reducing metal phase from the vessel.

19. The process of claim 18, wherein the molten reducing metal phase is separated from the vessel by decanting the molten reducing metal phase into another vessel.

20. The process of claim 18, wherein the molten reducing metal phase is separated from the vessel by siphoning the molten reducing metal phase into a capture tank.

21. The process of claim 20, wherein a negative relative pressure is employed in the capture tank to facilitate the siphoning of the molten reducing metal phase.

22. A process for the phase separation of excess molten reducing metal reductant from a vortex formed mixture of a metal powder and a metal salt, the process comprising:

heat treating a reaction vessel containing the mixture to a temperature above the melting point of the salt in the mixture to form a metal salt bath phase which includes the metal powder, and a separate molten reducing metal phase; and separating the molten reducing metal phase from the reaction vessel;

wherein the molten reducing metal is in a stoichiometric excess to the metal salt;

wherein the molten reducing metal comprises a Group I metal, a Group II metal, or aluminum; and wherein the metal salt comprises a halide of tantalum, nickel, aluminum, zirconium, vanadium, tin, titanium, silicon, niobium, hafnium, or mixtures thereof.

23. The process of claim 22, wherein the molten reducing metal phase is separated from the reaction vessel by decanting the molten reducing metal phase into another vessel.

24. The process of claim 22, wherein the molten reducing metal phase is separated from the reaction vessel by siphoning the molten reducing metal phase into a capture tank.

25. The process of claim 24, wherein a negative pressure is employed in the capture tank to facilitate the siphoning of the molten reducing metal phase from the reaction vessel into the capture tank.

* * * * *